United States Patent [19]

Hawrylo et al.

[11] 4,285,537

[45] Aug. 25, 1981

[54] SEALED CELL LIFT TOOL

[75] Inventors: Stan Hawrylo; Ed Neukirch; William J. Eberle, all of Reading, Pa.

[73] Assignee: General Battery Corporation, Reading, Pa.

[21] Appl. No.: 75,600

[22] Filed: Sep. 14, 1979

[51] Int. Cl.[3] ..... B66C 1/46

[52] U.S. Cl. ..... 294/93; 294/63 A

[58] Field of Search ..... 294/93, 63 R, 63 A, 294/64 R, 65, 81, 86 R, 87 R, 88, 99 R

[56] References Cited

U.S. PATENT DOCUMENTS

| | | | |
|---|---|---|---|
| 2,609,113 | 9/1952 | Huffman . | |
| 2,756,883 | 6/1953 | Schreck . | |
| 3,056,625 | 10/1962 | Timmerman . | |
| 3,167,196 | 1/1965 | Eberle . | |
| 3,219,382 | 11/1965 | Hugentobler | 294/93 |
| 3,400,967 | 9/1968 | Heller et al. | 294/93 |
| 4,081,093 | 3/1978 | Eberle . | |

*Primary Examiner*—James B. Marbert

*Attorney, Agent, or Firm*—Benasutti Associates, Ltd.

[57] ABSTRACT

An industrial battery cell lifting apparatus which includes an outer framework to which are attached, and adjustably spaced from each other, two endplate members. Inflatable bags are attached to the insides of the endplate members and the bags are connected by tubing through a control valve to a fluid source suitable to inflate the bags. Suitable lift members, such as eye bolts, are connected to the endplate members so that cables may be attached thereto for lifting the entire framework and endplate members. The battery cell to be lifted is positioned between the inflatable bags and is held securely in that position by inflating the bags. To release the battery cell, the bags are deflated. The bags may also be covered with a protective covering.

12 Claims, 6 Drawing Figures

SEALED CELL LIFT TOOL

BACKGROUND OF THE INVENTION

This invention relates to equipment for manufacturing batteries and in particular to an apparatus for lifting and handling entire batteries or individual cells thereof.

During the course of manufacturing a battery, and especially large, lead-acid batteries for industrial use, for it is usually necessary to lift and move one or more cells of the battery from one location to another. For example, at one point during the manufacturing cycle of an industrial battery cell, the cell consists of a container or jar containing all the parts of the cell. The cell cover is then fitted onto the jar, sealed thereto, and the cell terminals are then welded, for example, to lead bushings which have been pre-molded into the cell cover. At that time, in this particular process, it is necessary to be able to lift and handle the cells. These cells typically weigh from 50 to 200 lbs. each, and care must be taken to ensure safe and efficient moving of the cells. Typically at this stage in the manufacturing cycle of an industrial battery, the lifted cells are stored on pallets or are deposited directly within steel battery trays in whatever cell formation is required in order to form the particular battery being fabricated.

One of the major problems, however, with trying to arrange and move these heavy batteries or cells is the lack of any convenient means of moving them. To palletized and then subsequently handle each of the cells is a cumbersome process.

SUMMARY OF THE INVENTION

Consequently one of the major objectives of the present invention is to provide an apparatus for easily lifting and transporting battery cells.

Another object of the present invention is to provide an apparatus which will efficiently lift and transport the battery cells without causing damage to them.

These objects are achieved in the present invention by utilizing an apparatus which has an outer framework to which are attached, and adjustably spaced from each other, two endplate members. Inflatable bags are attached to the insides of the endplate members and the bags are connected by tubing through a control valve to a fluid source suitable to inflate the bags. Suitable lift members, such as eye bolts, are connected to the endplate members so that cables may attach thereto for lifting the entire framework and endplate members. The battery cell to be lifted is positioned between the inflatable bags and is held securely in that position by inflating the bags. To release the battery cell, the bags are deflated. The bags may also be covered with a protective covering.

BRIEF DESCRIPTION OF THE DRAWING

The above an further objects of the present invention will become more readily apparent from the following detailed description of the invention taken in conjunction with the formal drawings, wherein.

DETAILED DESCRIPTION OF THE INVENTION

Figure 1:
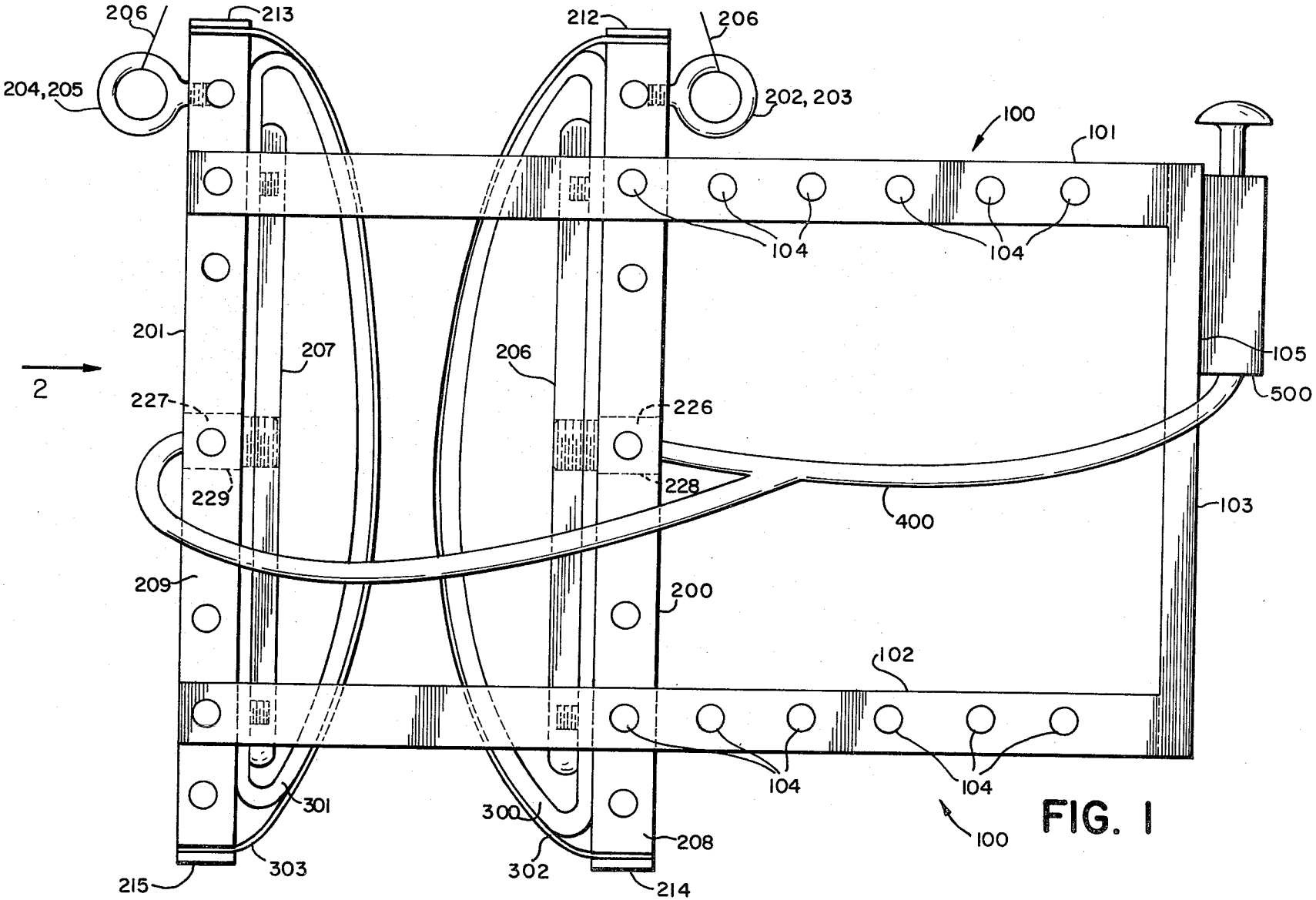
FIG. 1 is a side view of one embodiment of the invention.

Although specific forms of the invention have been selected for illustration in the drawings, and the following description is drawn in specific terms for the purpose of describing these forms of the invention, this description is not intended to limit the scope of the invention which is defined in the appended claims.

Referring initially to FIG. 1, it can be seen that the first embodiment of the present invention has an outer framework or slidebar frame, referred to generally as 100, with endplate members 200, 201 connected thereto. Mounted onto each of the endplate members is an inflatable bag 300, 301. These bags 300, 301 are connected by means of flexible tubing 400 to a fluid control valve 500, and the valve 500 is in turn adapted to be connected to a fluid, preferably compressed air, source. A covering 302, 303 may be positioned over the outer surfaces of the bags to protect them. Eye bolts 202–205 are affixed to the outer edges of the endplate members and act as anchors for connecting cables 206 thereto in order to lift the entire apparatus.

The cell or battery (not shown) which is to be lifted and moved is positioned between the two inflatable bags affixed to the endplate members, and then the valve 500 is actuated to inflate the bags so that they force securely against the cell thereinbetween. The frame with the cell therein is then lifted by the cable to a desired location. When the destination is reached the cell is lowered, and the pressure in the bags released, thereby allowing the cell to slide from between the bags. The apparatus may then simply be lifted away from the cell.

Figure 6:
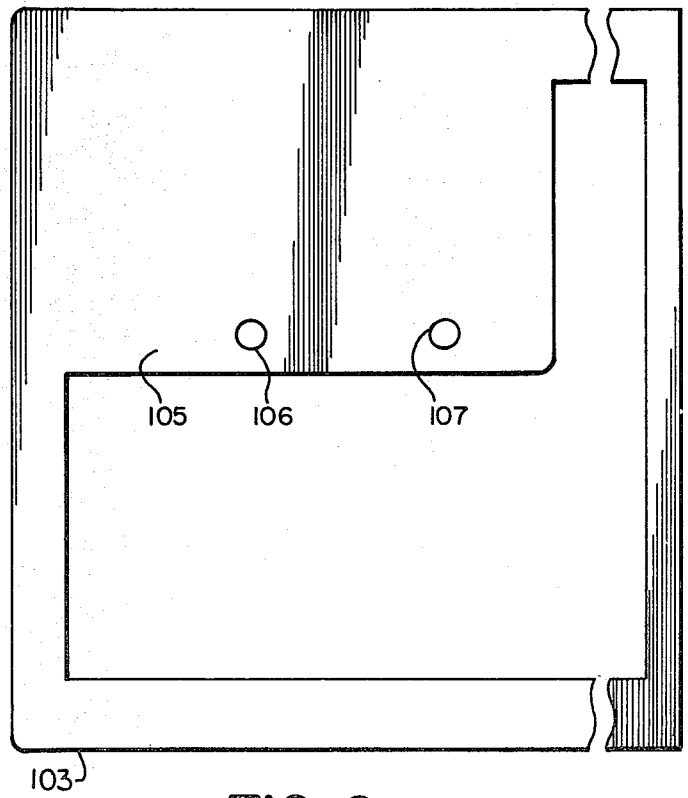
FIG. 6 is an end view of the frame member taken in the direction of arrow 6 in FIG. 5.
Figure 5:
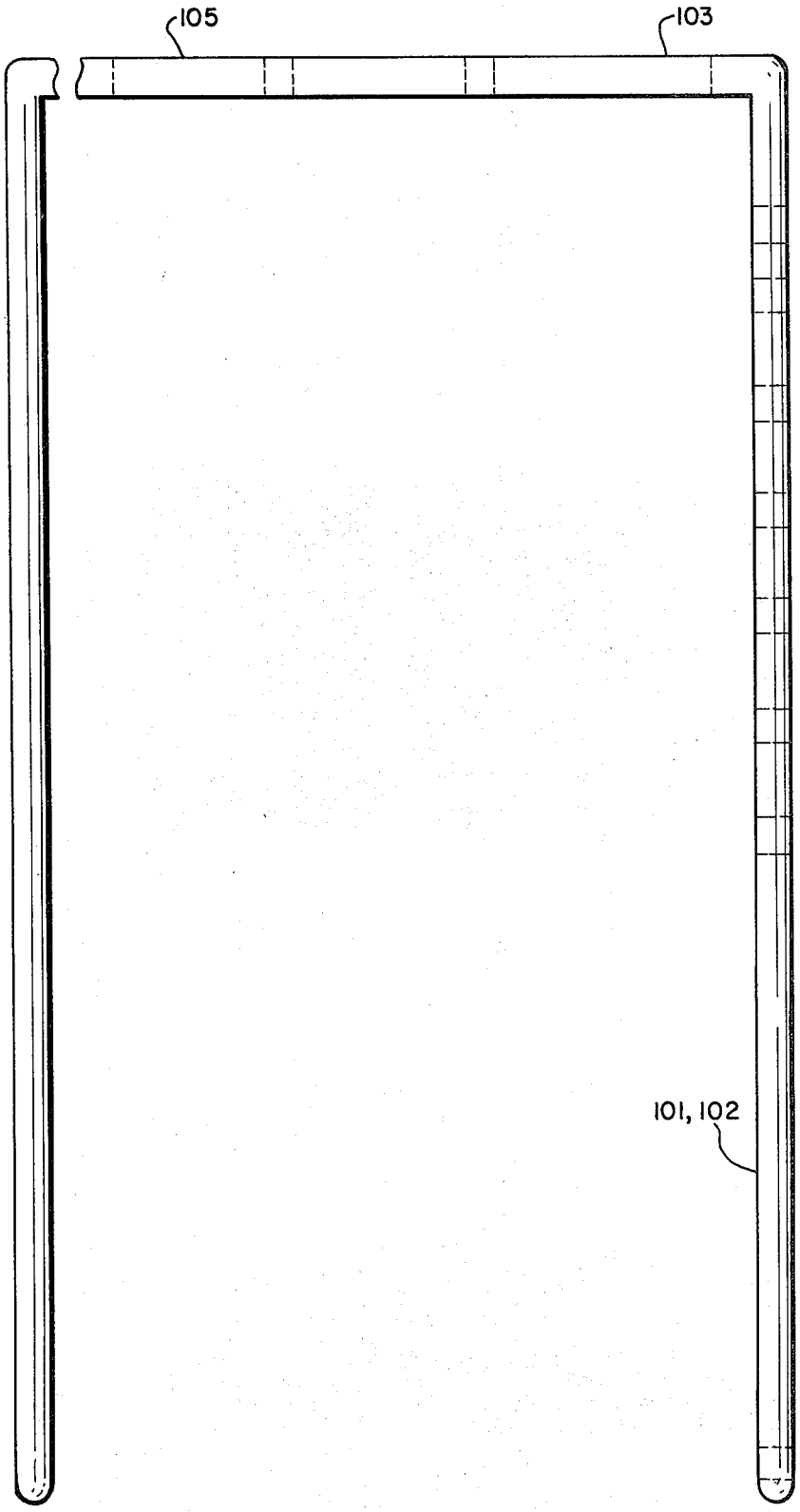
FIG. 5 is a top view of the outside frame member of the invention.
Figure 4:
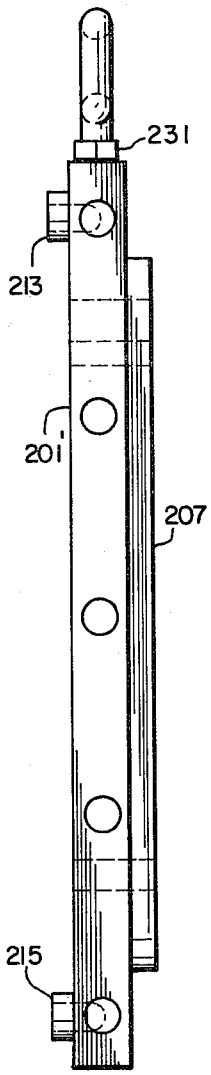
FIG. 4 is a side view of the second embodiment taken in the direction of arrow 4 in FIG. 3.

The slide bar frame 100 is shown in FIGS. 1, 5 and 6. As can be seen a substantially U-shaped frame with upper and lower side frame members 101, 102 and an end frame members 103 affixed to the side frame members are provided. Along the length of the side frame members 101, 102 are a plurality of holes 104. These holes are used to attach the side frame members to the endplate members 200, 201. Threaded bolts or other fastening devices which allow for quick disconnect and reconnect may be used to attach the side frame members to the endplate members. By providing a plurality of these holes 104 and aligning them both vertically and horizontally, it is possible to compensate for and adjust the apparatus to accept battery cells of different widths by varying the position of endplate member 200, and all that needs to be done to relocate the endplate member 200 is to position the endplate member at the appropriate holes and secure it therethrough.

The end view of the framework shown in FIG. 6 discloses a brace 105 is provided for connecting the fluid control valve 500 to the framework. One way to achieve this connection is to simply bolt or screw the control valve onto the framework at 105 through holes 106, 107 formed therein.

The two inflatable bags 300, 301 which are mounted on the endplate members 200, 201, respectively, are comprised of lengths of longitudinally split hose material. The split side of the hose is placed against the inside surface of the endplate members, and cover plates 206, 207 are placed inside the hose material, whereby the ends of the hose material are positioned between the endplate members and the cover plates. Screws or bolts or any other suitable means may be used to affix the cover plate securely to its associated endplate.

Figure 2:
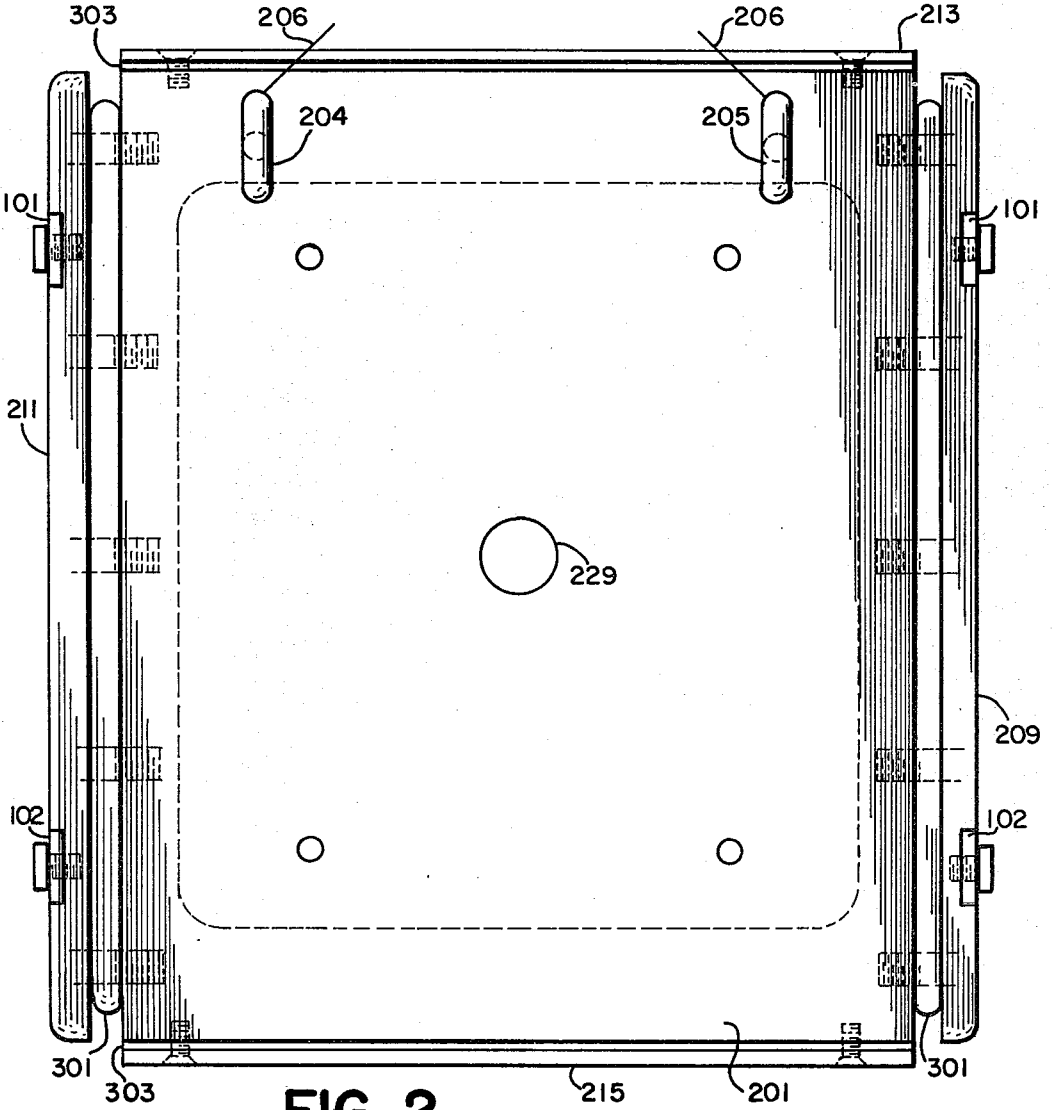
FIG. 2 is an end view of the invention taken in the direction of arrow 2 in FIG. 1.

In order to substantially close the ends of the hose material forming the bags, end cover plates 208–211 are provided which are designed to be fastened to the edges of each endplate member with the hose material held between the end cover plates and the side of the endplate. FIG. 2 shows the assembled apparatus with the ends of the hose material 301 held between the edge of the endplate member 201 and cover plates 210, 211. Each end cover plate may be secured to the endplate member in any suitable manner, such as using threaded screws. It should be recognized that all of the end cover plates at the edges and the inside cover plates 206, 207 should be easily removable so that the lengths of hose material may be replaced as necessary.

(Also shown in FIG. 2 is the connection of the side frame members 101, 102 to these edge cover plates 209, 211; the end cover plates, of course, in turn being connected to the endplate member 201.)

It is not the specific intention of clamping the hose material between the cover plates and the endplate members to completely seal the material or the bag which is created so that none of the fluid used to inflate the bag will escape. Usage has shown that it is only necessary that the material be tightly clamped so that a substantial, as opposed to a complete, sealing is achieved. The continuous supply of fluid through the tubing 400 will compensate for any leakage which might occur.

Also connected to the top and bottom edges of the endplate members 200, 201 may be additional cover plates 212–215. These plates are used to clamp a protective covering 302, 303 into position over the hose material of the inflatable bags. It is optional to provide these additional protective coverings 302, 303; however, by using these covers, the useful life of the inflatable bags are increased since wear on the bags, due to the rubbing and sliding of the cells thereagainst or contact with acid, is minimized. Possible materials for use as covering material include cloth materials, such as burlap, and synthetic material, such as vinyl plastics. Like the side cover plates, these top and bottom edge cover plates 212–215 are attached in any suitable manner, such as using threaded screws.

As discussed above, the entire purpose of the apparatus is to transport cells or batteries in a more convenient manner. The four eye-bolts 202–205, securely threaded into the endplate members, are provided to have cables 206 attached thereto which slide through a separate O-ring (not shown). By having all of the cables pass through the O-ring, all that is required to lift the apparatus and the battery or cell held thereby is to raise the O-ring. This can be achieved by using hoist equipment which is generally found in most manufacturing situations. In the embodiment shown in FIGS. 1 and 2, the eye-bolts 202–205 are threaded into the outer face of each endplate member 200, 201 at a right angle thereto.

The fluid most recommended for inflating the inflatable bags is compressed air. Air from a compressed air source (not shown) is connected to the fluid control valve 500 which will control the flow of air to each of the bags. One such control valve is a three-way detented valve. This valve is connected by means of any flexible tubing 400 to the inflatable bags through the endplate members and the cover plates. The tubing is connected to threaded connections which fit through openings 228, 229 respectively in the endplate members 200, 201 so that the compressed air is supplied directly into the bags. By correctly operating the valve, sufficient air can be supplied to the bags to inflate them securely around the cell or battery. A maintained air supply at 5 psi is sufficient to hold the cells while lifting. When it is desired to release the pressure on the bags to remove the cell, the position of the control valve is changed to allow for a slow, controlled release of air. In this way, the cell will be lowered slowly as the air is released. A standard needle bleed valve will ensure a gradual elimination of the air pressure.

Figure 3:
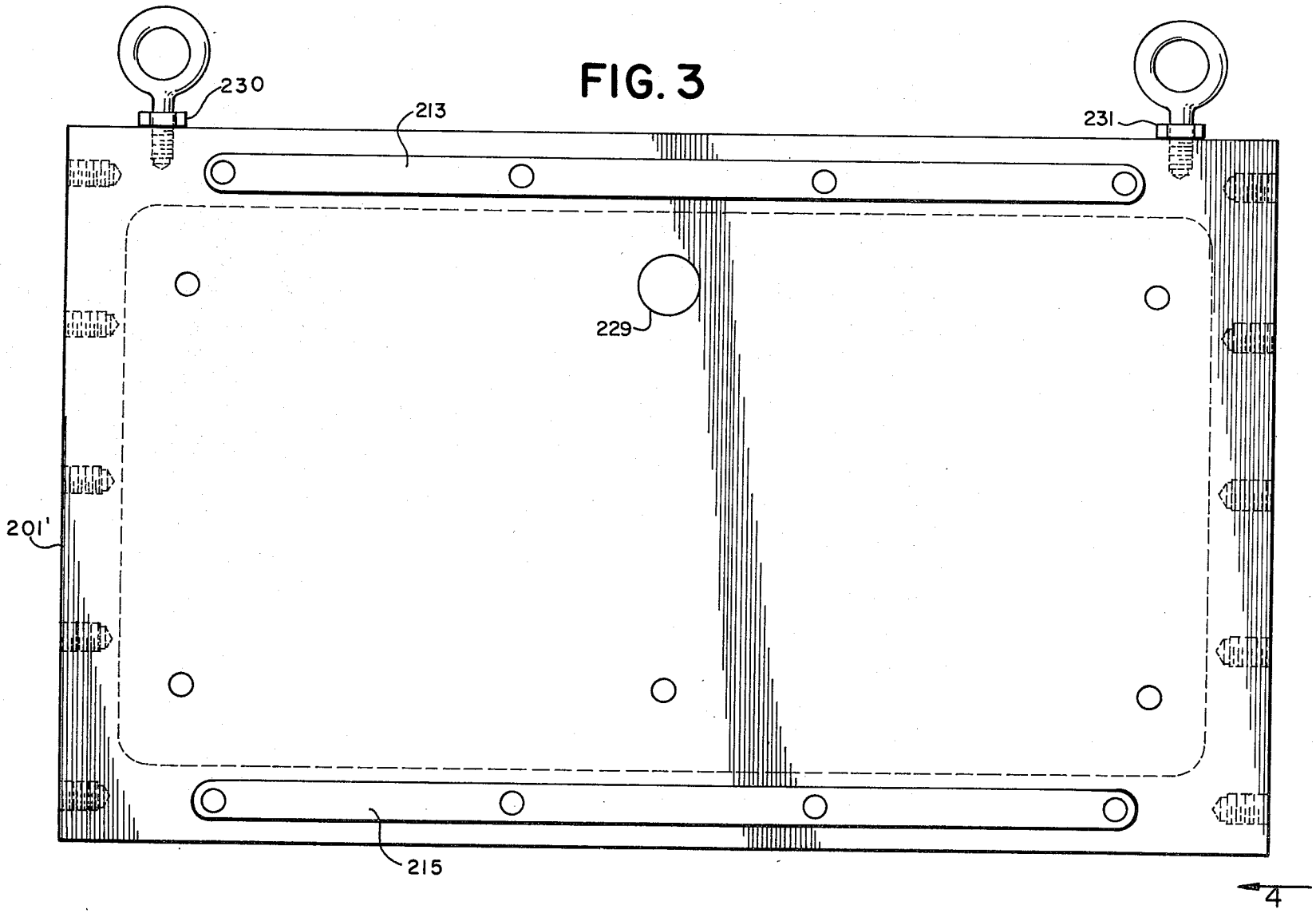
FIG. 3 is an end view taken in the same direction as FIG. 2 of a second embodiment of the invention.

The second embodiment of the apparatus as shown in FIG. 3 presents a slightly modified endplate member 201'. This endplate member functions essentially the same as the previously described endplates; however, the structural arrangements have been altered. First of all, rather than provide the eye-bolts at right angles to the end face of the endplate member, these eye bolts are attached perpendicular to the top edge of the endplate. Also, the bolts are threaded into the endplate member and a lock washer and nut 230, 231 are used to secure the eye bolts in place. Secondly, in order to attach the bag covers 302, 303 to the endplates, rather than position the cover plates 212–215 across the top and bottom edges of the end plate members as in the first embodiment, the cover plates are fastened to the outer face of the endplate member—with the cover material overlapping the top and bottom edges of the end plate.

Each of the eye-bolts used in either of the embodiments is preferably capable of supporting a fifty pound load. The o-ring, preferably, can support at least a 250 pound load.

One of the types of hose material which may be used to produce the inflatable bags is simply a circular woven polyvinyl alcohol fiber. The fiber provides sufficient reinforcing strength, while the material itself is not water absorbent. Furthermore, if the hose is used alone, i.e., without the cover material, it presents a smooth surface which will help to prevent the surface of the cell from becoming abraded when the bags are deflated and the cell is allowed to slip from between the endplate members. The ability to eliminate any cell scratching helps prevent points where future stress cracks might occur and shorten the life of the battery.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. A lifting apparatus comprising:

(a) a framework;

(b) at least two endplates adjustably spaced from each other within said framework;

(c) at least two inflatable means opposing each other and connected to each of said endplates for inflating and holding an object between said endplates, wherein each inflatable means comprises a hose-like material open at each end and slit longitudinally from end to end;

(d) fluid supply means adapted to be connected to a fluid source and to said inflatable means for supplying and controlling a flow of fluid to said inflatable means, whereby supplying fluid to said inflatable means through said fluid supply means causes said inflatable means to inflate and expand toward each other; and (e) lift means connected to said endplates for lifting said endplates thereby.

2. An apparatus as claimed in claim 1, wherein said endplates are comprised of:

(a) endplate members adjustably connected to said framework;

(b) cover plates connected to said endplate members, so that edges defined along said longitudinal slit of each hose-like material are fitted and held between the cover plates and the endplate member; and (c) side plates connected to each endplate member, so that edges defined along said open ends of said hose-like material are fitted and held between said side plates and said endplate member.

3. An apparatus as claimed in claim 1, further comprising cover means connected to each endplate and fitted over said inflatable means for protecting said inflatable means.

4. An apparatus as claimed in claim 3, wherein said cover means is comprised of:

(a) cloth-like material positioned over said inflatable means; and (b) side plate means connected to said endplates for attaching said cloth-like material to said endplates.

5. An apparatus as claimed in claim 1, wherein said fluid supply means is comprised of:

(a) flexible tubing extending through each endplate into said inflatable means attached thereto; and (b) a fluid control valve connected to said tubing for controlling the flow of fluid through said tubing into said inflatable means.

6. An apparatus as claimed in claim 5, wherein said fluid control valve is attached to said framework.

7. An apparatus as claimed in claim 1, wherein said opposing, inflatable means are adapted to directly contact an item to be lifted.

8. An apparatus as claimed in claim 7, wherein said contact between said inflatable means and said element is substantially continuous.

9. An apparatus as claimed in claim 1, wherein said framework is substantially U-shaped, and wherein said U-shaped framework lies in a substantially vertical plane and is attached to said endplates along their lateral edges.

10. An apparatus as claimed in claim 1, wherein said inflatable means define a domed enclosure over said endplates.

11. An apparatus as claimed in claim 10, wherein said domed enclosures have an arcuate cross-section of no more than 180°, and wherein the edges of the domed enclosures are attached to said endplates.

12. An apparatus as claimed in claim 3, wherein said endplates, cover plates, side plates and hose-like material combine to form a cavity adapted to contain a fluid therein, only a portion of which cavity is enclosed by said hose-like material.

* * * * *